US007401897B2

(12) United States Patent
Ito et al.

(10) Patent No.: US 7,401,897 B2
(45) Date of Patent: Jul. 22, 2008

(54) INKJET HEAD

(75) Inventors: Atsushi Ito, Owariasahi (JP); Yasuo Okawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 302 days.

(21) Appl. No.: 10/876,574

(22) Filed: Jun. 28, 2004

(65) Prior Publication Data

US 2004/0263584 A1 Dec. 30, 2004

(30) Foreign Application Priority Data

Jun. 30, 2003 (JP) ..... 2003-188997

(51) Int. Cl.
*B41J 2/14* (2006.01)
*B41J 2/015* (2006.01)

(52) U.S. Cl. ..... 347/47; 347/20

(58) Field of Classification Search ..... 347/20, 347/40, 45–47, 54, 56, 63, 70, 71; 216/27; 29/890.1

See application file for complete search history.

(56) References Cited

U.S. PATENT DOCUMENTS

| | | | |
|---|---|---|---|
| 6,170,934 | B1 | 1/2001 | Fujisawa et al. |
| 6,290,341 | B1 | 9/2001 | Furuhata et al. |
| 6,334,661 | B1 | 1/2002 | Steinfield et al. |
| 6,382,778 | B1 | 5/2002 | Iijima et al. |
| 6,422,686 | B1 | 7/2002 | Ishinaga et al. |
| 2001/0040609 | A1 | 11/2001 | Furuhata et al. |
| 2004/0263584 | A1 | 12/2004 | Ito et al. |
| 2005/0006338 | A1 | 1/2005 | Furuhata et al. |

FOREIGN PATENT DOCUMENTS

| | | | | |
|---|---|---|---|---|
| CN | 2794826 | | 7/2006 | |
| EP | 1 024 005 | A1 | 8/2000 | |
| EP | 1 055 518 | A2 | 11/2000 | |
| EP | 1 108 545 | A1 | 6/2001 | |
| EP | 1 152 749 | A1 | 11/2001 | |
| EP | 1 153 749 | A1 | 11/2001 | |
| JP | A-03-244811 | | 10/1991 | |
| JP | 3297651 | * | 12/1991 | |
| JP | 403286872 | A * | 12/1991 | ..... 347/47 |
| JP | A-03-297651 | | 12/1991 | |
| JP | A-06-190307 | | 7/1994 | |
| JP | A-08-111027 | | 4/1996 | |
| JP | 10-119269 | | 5/1998 | |
| JP | A-10-226070 | | 8/1998 | |
| JP | A-11-227194 | | 8/1999 | |
| JP | 2000-33699 | | 2/2000 | |
| JP | 2000-334952 | | 12/2000 | |
| JP | 2001-246764 | | 9/2001 | |
| JP | A-2002-052723 | | 2/2002 | |

* cited by examiner

*Primary Examiner*—Shih-Wen Hsieh
(74) *Attorney, Agent, or Firm*—Oliff & Berridge, PLC

(57) ABSTRACT

There is provided a inkjet head, which is provided with a nozzle plate that has a plurality of nozzles from which ink is ejected, and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate. Further, a gap is formed between opposed surfaces of the cover plate and the nozzle plate. The gap is filled with the adhesive. The gap has a wide gap portion whose thickness is larger than that of the other portion of the gap.

17 Claims, 10 Drawing Sheets

INKJET HEAD

BACKGROUND OF THE INVENTION

The present invention relates to an inkjet head employed in printing devices such as an inkjet printer and a facsimile machine.

In general, the inkjet head has a laminated structure including a plurality of thin plates. The plurality of the thin plates includes a nozzle plate through which a plurality of nozzles are formed. In the inkjet head, the plurality of nozzles communicate with pressure chambers, respectively. The inkjet head further has actuator units that operate to apply pressure to each of the pressure chambers.

By the operation of the actuator units, the pressure chamber sucks/ejects ink so that a certain amount of ink is ejected from each nozzle. Each thin plate has openings that constitute an ink flow channels each connecting the nozzle and the pressure chamber.

The plurality of thin plates include a cover plate which is situated on a pressure chamber side of the nozzle plate and which has an opening corresponding to the nozzle. In a manufacturing process of the inkjet head, an adhesive is applied to an adhesive layer between the cover plate and the nozzle plate, so that the cover plate and the nozzle plate are adhered to each other. Typically, to make the adhesive layer thinner, the adhesive having relatively low viscosity is selected and used.

If the amount of the adhesive applied to the adhesive layer between the cover plate and the nozzle plate is less than an appropriate amount, sufficient adhesive force can not be obtained. Further, in such a case, air gaps may be formed in the adhesive layer, and therefore the ink may enter the air gaps. If the ink stays in the air gaps for a relatively long time, the ink in the air gaps may alter its quality, which deteriorates printing quality.

If the amount of the adhesive is too large, a portion of the adhesive applied to the adhesive layer may flow into the nozzle. If such a phenomenon occurs, the portion of the adhesive sets in the nozzle, and thereby ejecting directions of the ink from the nozzles may become nonuniform.

Japanese Patent Provisional Publication No. 2000-33699 discloses an inkjet head configured such that a diameter of an opening of a cover plate, which is adhered to a nozzle plate having a nozzle orifice, is broadened. With this structure, the accuracy of ejecting operation of ink is not deteriorated even if a portion of the adhesive flows into a nozzle during a manufacturing process. The diameter of the opening of the cover plate is determined by considering the amount of the adhesive that flows into the nozzle.

SUMMARY OF THE INVENTION

However, when the inkjet head is configured as indicated in the publication 2000-33699, the diameter of the opening of the cover plate increases, and the amount of ink ejected from the nozzle per one ejection motion also increases. In such a case, fine control of the amount of the ink to be ejected from the nozzle can not be attained. Consequently, the accuracy of the ejecting operation of the ink may be deteriorated.

The present invention is advantageous in that it provides an inkjet head configured such that an adhesive applied to an adhesive layer between a cover plate and a nozzle plate does not overflow into a nozzle.

According to an aspect of the invention, there is provided a inkjet head, which is provided with a nozzle plate that has a plurality of nozzles from which ink is ejected, and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate. Further, a gap is formed between opposed surfaces of the cover plate and the nozzle plate. The gap is filled with the adhesive. The gap has a wide gap portion whose thickness is larger than that of the other portion of the gap.

With this configuration, a portion of the adhesive, which is pressed toward the nozzles when the nozzle plate and the cover plate are laminated, can be trapped in the wide gap portion. Consequently, it is prevented that the portion of the adhesive protrudes into a through hole of the nozzle.

Optionally, the wide gap portion may be formed in the vicinity of each of the plurality of nozzles.

Still optionally, a thickness of the wide gap portion may become larger at a point closer to corresponding one of the plurality of nozzles. With this structure, the adhesive which flows into the wide gap portion is forced by a capillary action toward a direction opposite to the nozzle side. Consequently, it is reliably prevented that the adhesive flows into the nozzle.

In a particular case, the wide gap portion may have a form of a wedge in a cross section parallel with a lamination direction of the cover plate and the nozzle plate. With this structure, it becomes possible to trap the adhesive which flows into the wide gap portion by an effect of the capillary action.

In a particular case, at least one of the opposed surfaces of the cover plate and the nozzle plate forming the wide gap portion may have a groove.

In particular case, at least one of the opposed surfaces of the cover plate and the nozzle plate forming the wide gap portion may have a countersunk portion.

In a particular case, a surface of the cover plate forming the wide gap portion may be a planer surface, and a surface of the nozzle plate forming the wide gap portion may be configured such that a thickness of the wide gap portion becomes larger at a point closer to corresponding one of the plurality of nozzles. With this structure, it becomes possible to trap the adhesive which flows into the wide gap portion by an effect of the capillary action.

Optionally, the surface of the nozzle plate forming the wide gap portion may be configured to be a curved surface.

Still optionally, the surface of the nozzle plate forming the wide gap portion may be continuously connected to an inside surface of the corresponding one of the plurality of nozzle. With this configuration, it becomes possible to simultaneously form the wide gap portion and the curved surface by press working.

Still optionally, a plurality of through holes corresponding to the plurality of nozzles may be formed through the nozzle plate by press working. In this case, each of the plurality of through holes has the curved surface and the inside surface.

Still optionally, the curved surface may be formed by an effect of deep drawing of the press working.

In a particular case, a thickness of the wide gap portion may firstly increase and then decrease gradually at a point closer to corresponding one of the plurality of nozzles. With this configuration, it becomes possible to securely trap the adhesive in the wide gap portion.

According to another aspect of the invention, there is provided an inkjet head, which is provided with a nozzle plate that has a plurality of nozzles from which ink is ejected, and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate.

In this structure, the nozzle plate has a plurality of through holes respectively corresponding to the plurality of nozzles. Each of the plurality of through holes includes: a first hole portion that has a cylindrical inside surface, one end of the first hole portion being situated on an ejecting side surface of the nozzle plate; a second hole portion that has an conical inside surface continuously connected to the other end of the first hole portion, a diameter of the second hole portion monotonously increases at a point closer to a cover plate side; and a third hole portion having an inside surface which is continuously connected to the second hole portion, a diameter of the third hole portion increases at a point closer to the cover plate side, one end of the third hole portion facing an ejecting side surface of the cover plate, the diameter of the third hole portion on a surface of the nozzle plate opposed to the ejecting side surface of the nozzle plate being larger than a diameter of corresponding one of the plurality of openings of the cover plate.

A gap is formed between opposed surfaces of the cover plate and the nozzle plate, the gap being filled with the adhesive. The gap has a wide gap portion whose thickness is larger than that of the other portion of the gap. Further, the wide gap portion is formed for each of the plurality of nozzles. The wide gap portion being formed by the ejecting side surface of the cover plate and a surface of the third hole portion of each of the plurality of through holes of the nozzle plate.

With this configuration, a portion of the adhesive, which is pressed toward the nozzles when the nozzle plate and the cover plate are laminated, can be trapped in the wide gap portion formed between the cover plate and the third hole portion of the nozzle plate. Consequently, it is prevented that the portion of the adhesive protrudes into the through hole of the nozzle.

DETAILED DESCRIPTION OF THE EMBODIMENTS

First Embodiment

Figure 1:
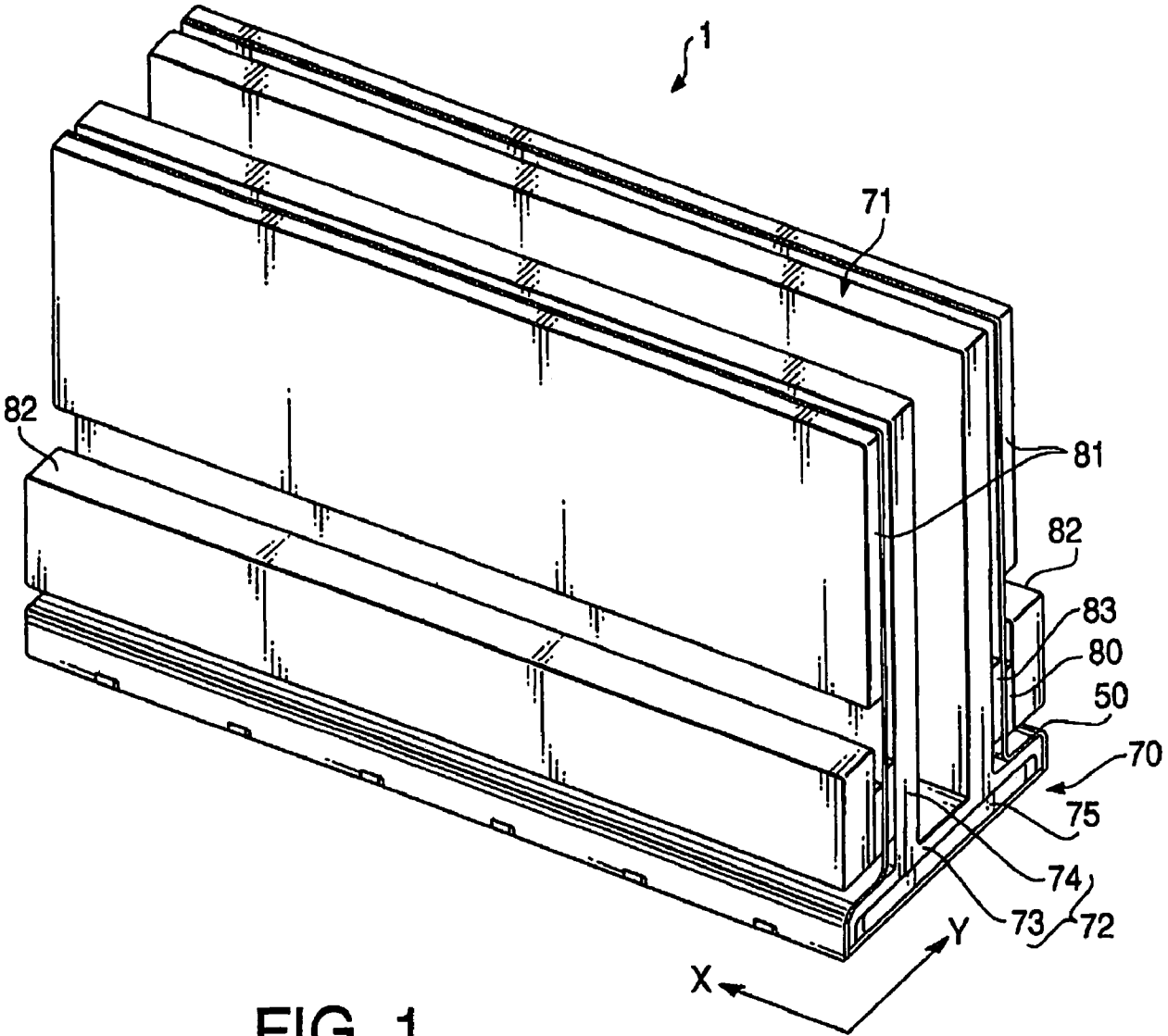
FIG. 1 is a perspective view of an inkjet head according to a first embodiment of the invention.

FIG. 1 is a perspective view of an inkjet head 1, employed, for example, in an inkjet printer, according to a first embodiment of the invention. The inkjet head 1 has a head unit 70 and a base 71. The inkjet head 70 is supported by the base 71. In the inkjet printer, the inkjet head 1 is moved in a main scanning direction (X direction) while a sheet of paper is moved in an auxiliary scanning direction (Y direction) which is perpendicular to the main scanning direction, so that two dimensional images can be formed on the sheet of paper.

As described in detail later, the inkjet head 1 has an ink flow channel unit 2 and an actuator unit 4 (see FIGS. 2 and 4). The ink flow channel unit 2 has a plurality of pressure chambers 10 and a plurality of nozzles 8 for rejecting ink. The actuator unit 4 is used to apply pressure to the pressure chambers 10 to eject the ink from the nozzles 8.

The base 71 includes a base block 75 and a holder 72. The base block 75 is attached to an upper surface of the head unit 70 to support the head unit 70. The holder 72 includes a body portion 73 and a supporting portion 74. As shown in FIG. 1, the supporting portion 74 is elongated toward a direction opposed to the head unit 70 side, so that the inkjet head 1 is supported in the inkjet printer.

On an outer region of the base 71, an FPC (flexible printed circuit) 50 is attached through an elastic member 81 such as a sponge. The FPC 50 electrically connects electrodes provided on the actuator unit 4 to a driver IC 80 which drives the actuator unit 4. Further, the FPC 50 electrically connects the driver IC 80 and a control board 81. As shown in FIG. 1, a heatsink 82 is attached to the driver IC 80 for heat radiation of the driver IC 80.

Figure 2:
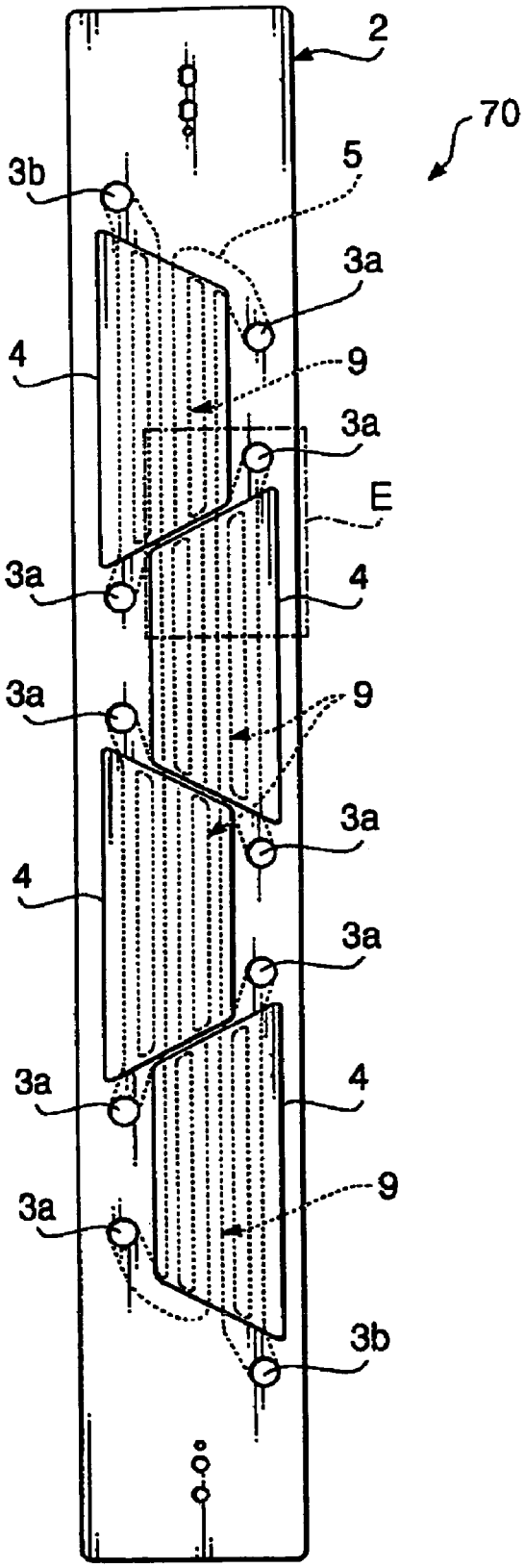
FIG. 2 is a plan view of a head unit of the inkjet head shown in FIG. 1.

FIG. 2 is a plan view of the head unit 70. As shown in FIG. 2, the ink flow channel unit 2 has a rectangular form and has a plurality of ejection element groups 9. Adjacent ones of the ejection element groups 9 are shifted, in directions opposite to each other, by the same distance with respect to a center line of a shorter side of the ink flow channel unit 2. Each ejection element group 9 has a trapezoidal form.

On each ejection element group 9, the actuator unit 4 having an piezoelectric actuator is attached. The ejection element groups 9 are supplied with ink from manifolds 5 which communicate with ink reservoirs (not shown) via apertures 3*a* and 3*b*.

Figure 3:
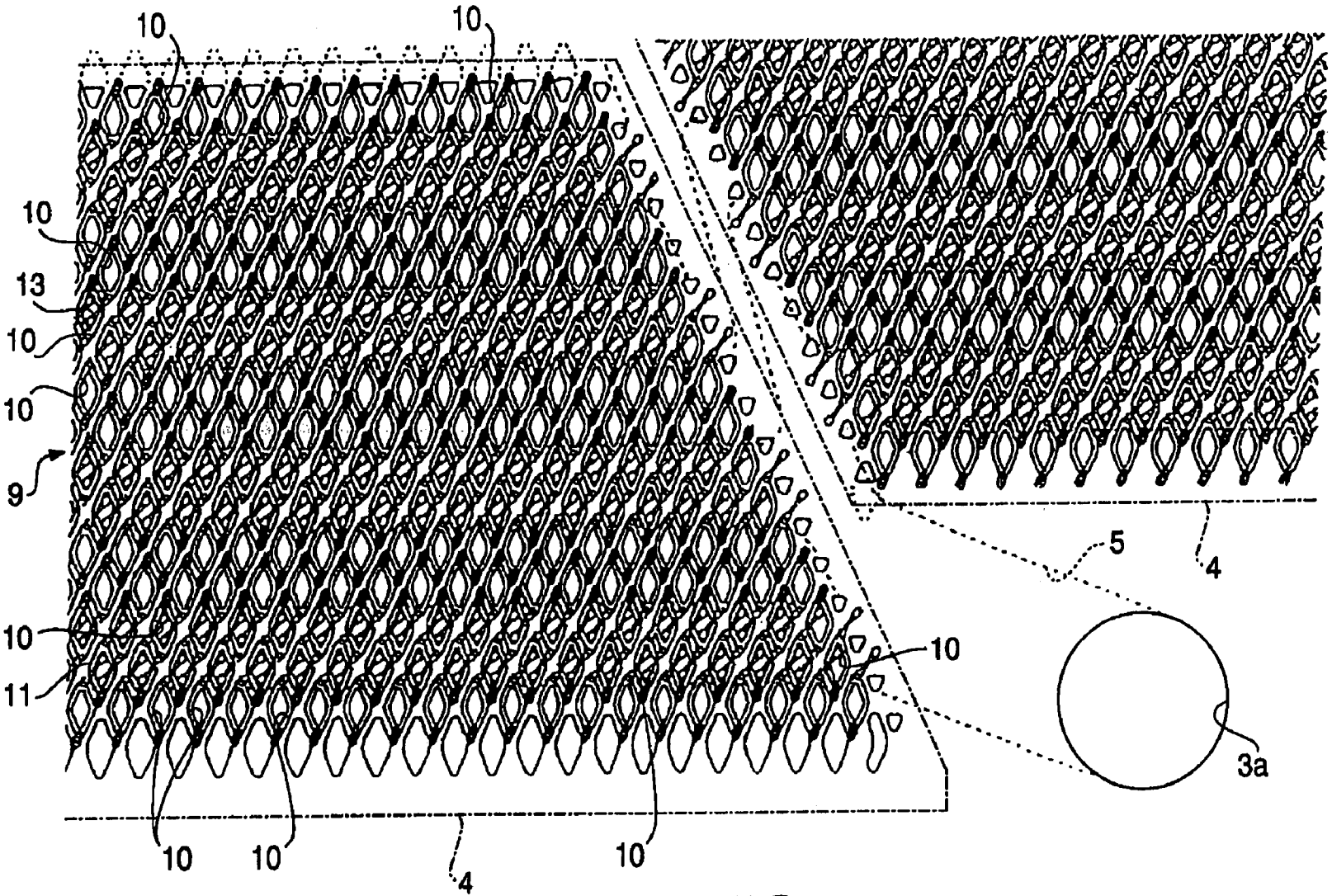
FIG. 3 is an enlarged view of an ejection element group shown in FIG. 2.

FIG. 3 is an enlarged view of a section E shown in FIG. 2. As shown in FIG. 3, each ejection element group 9 is formed with a number of ejection elements 11 arranged in a matrix. As described in detail later, each ejection element 11 has an aperture 13 communicating with the manifold 5, the pressure chamber 10 and the nozzle 8 (see FIGS. 4 and 5).

Figure 4:
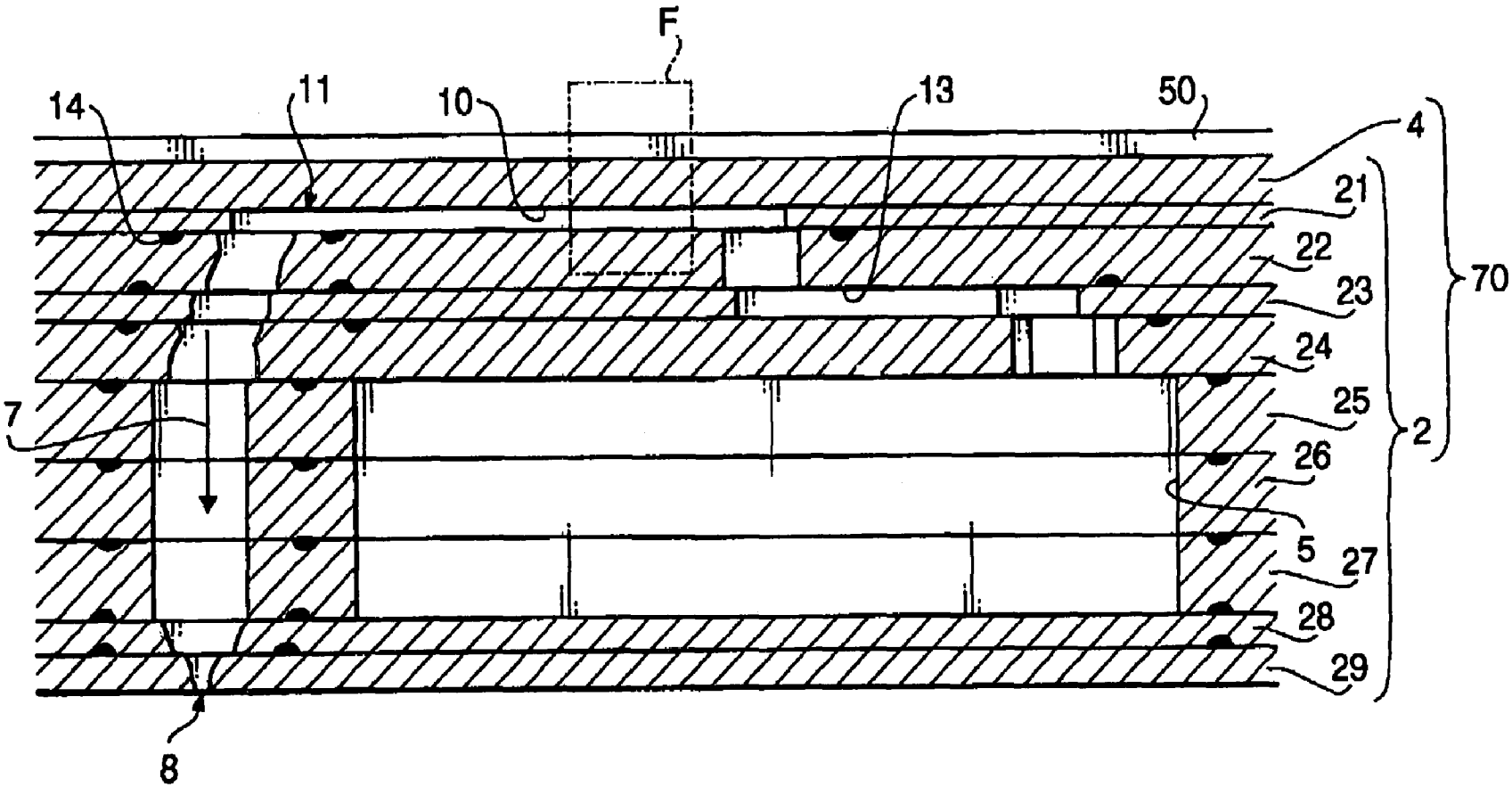
FIG. 4 is a cross sectional view of an ejection element shown in FIG. 3.

FIG. 4 is a cross sectional view of the ejection element 11. As shown in FIG. 4, the ink flow channel unit 2 has a laminated structure of a plurality of thin plate layers each made of, for example, Ni (nickel). More specifically, the ink flow channel unit 2 has, from an actuator side, a cavity plate 21, a base plate 22, an aperture plate 23, a supply plate 24, manifold plates 25, 26 and 27, a cover plate 28, and a nozzle plate 29.

The pressure chamber 10 is formed by the cavity plate 21. By the operation of the actuator unit 4, the pressure chamber 10 sucks in the ink from the manifold 5 and applies pressure to the ink introduced therein to eject the ink from the nozzle 8. The aperture plate 23 is formed with the aperture 13 and an opening constituting a part of an outlet channel 7. The aperture 13 is used to decrease/increase flow of the ink flowing from the manifold 5 to the pressure chamber 10. The base plate 22 is formed with an opening through which the aperture 13 communicates with the pressure chamber 10, and an opening constituting a part of the outlet channel 7.

By a laminated structure of the manifold plates 25, 26 and 27, the manifold 5 and openings constituting a part of the outlet channel 7 are formed. The cover plate 28 is formed with openings constituting the outlet channel 7. The nozzle plate 29 is formed with openings constituting the nozzles 8 from which the ink flowing from the pressure chamber 10 is ejected.

By the above mentioned laminated structure, a plurality of ink flow channels are formed in the ink flow channel unit 2. As shown in FIG. 4, each thin plate layer has grooves 14 which trap redundant glue. By the grooves 14, an occurrence of clogging of the ink flow channel and/or variations of resistance of the ink flow channel are prevented, and therefore ejection performances of the plurality of ejection elements are uniformed.

Figure 5:
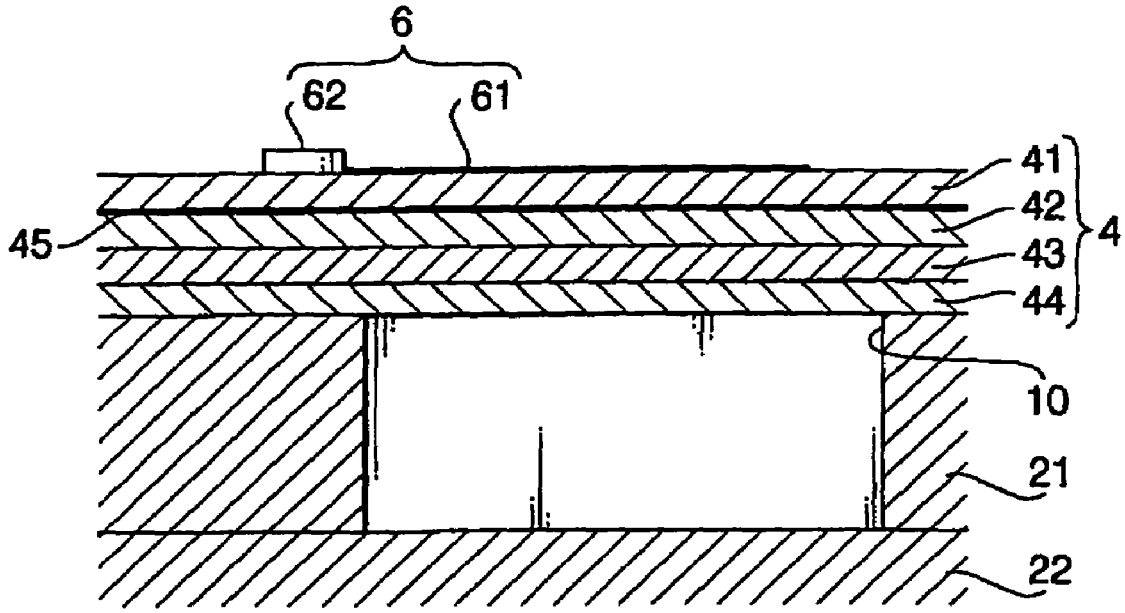
FIG. 5 is shows a detailed structure of an actuator unit.

FIG. 5 is an enlarged view of a section F shown in FIG. 4 illustrating a detailed structure of the actuator unit 4. As shown in FIG. 5, the actuator unit 4 has a laminated structure of a plurality of piezoelectric sheets 41, 42, 43 and 44, and an internal electrode 45. On a surface of the actuator unit 4 farthest from the ink flow channel unit 2, an electrode unit 6 is formed for each pressure chamber 10.

Figure 6:
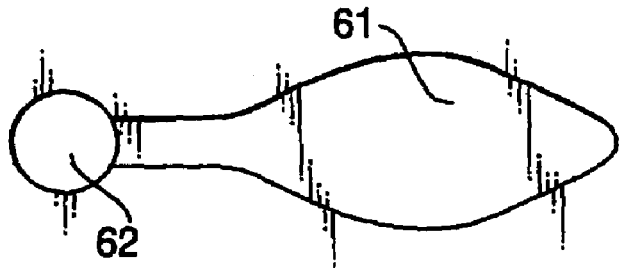
FIG. 6 is a plan view of an electrode unit shown in FIG. 5.

FIG. 6 is a plan view of the electrode unit 6. As shown in FIG. 6, the electrode unit 6 has a land 62 and an electrode 61. The electrode 61 has a rhombic shape which is substantially the same as the shape of the pressure chamber 10 when the electrode 61 and the pressure chamber 10 are viewed as plane views. Thus, the actuators respectively corresponding to ejection elements 11 are formed.

With this structure, when a voltage is applied to the electrode 61, the pressure chamber 10 distorts and the volumetric capacity of the pressure chamber changes, so that suction/ejection of the ink can be performed.

Figure 7:
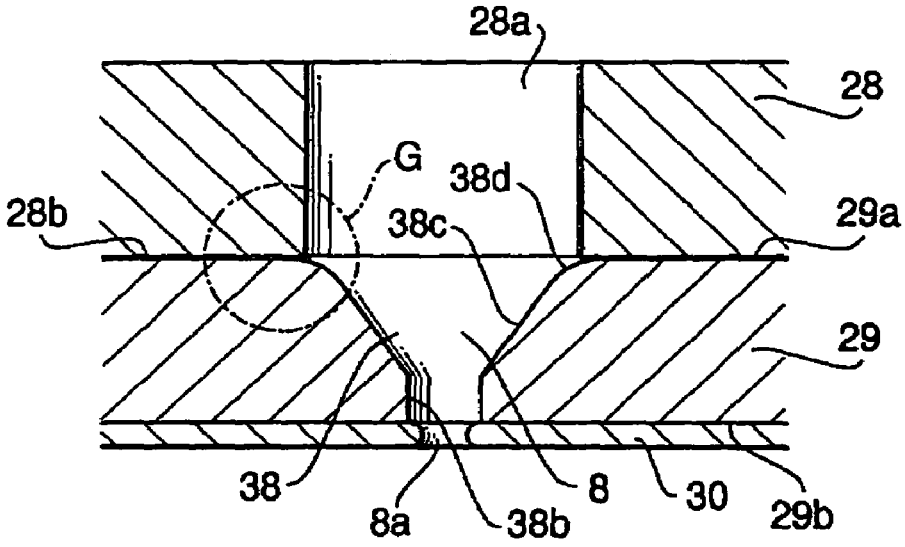
FIG. 7 is a cross sectional view of the head unit illustrating a detailed configuration of the vicinity of the nozzle.

FIG. 7 is a cross sectional view of the head unit 70 illustrating a detailed configuration of the vicinity of the nozzle 8. As shown in FIG. 7, on a surface 29*a*, which is a pressure chamber side surface of the nozzle plate 29, an opening is formed. Further, a through hole 28*a* is formed through the cover plate 28 at a position corresponding to a position of the nozzle 8.

A portion of a surface 28*b* of the cover plate 28 except a region of the through hole 28*a* constitutes an adhesive region. Also, a portion of the surface 29*a* of the nozzle plate 29 except a region of the nozzle 8 constitutes the adhesive region. In a manufacturing process of the inkjet head 1, the adhesive region formed between the cover plate 28 and the nozzle plate 29 is filled with the adhesive, so that the cover plate 28 and the nozzle plate 29 are adhered to each other.

As shown in FIG. 7, the nozzle 8 is configured as a portion of a through hole 38 formed through the nozzle plate 29. The through hole 38 tapers down toward a surface 29*b* situated on an ejection side of the nozzle plate 29. More specifically, the through hole 38 has a three portions including a cylindrical surface portion 38*b* (a first surface portion) configured to be a cylindrical shape, a conical surface portion 38*c* (a second surface portion) configured to be a conical shape, and a curved surface portion 38*d* (a third surface portion).

The cylindrical surface portion 38*b* which defines a diameter of the nozzle 8 is continuously connected to the conical surface portion 38*c*. Also, the conical surface portion 38*c* is continuously connected to the curved surface portion 38*d*.

The conical surface portion 38*c* has a shape whose diameter increases monotonously toward the pressure chamber side. The maximum diameter of the conical surface portion 38*c* is smaller than the diameter of the through hole 28*a*.

The diameter of the curved surface portion 38*d* increases at a rate higher than the rate of the monotonous increasing of the diameter of the conical surface portion 38*c*. The maximum diameter of the curved surface portion 38*d* is larger than the diameter of the through hole 28*a*. As described in detail later, a portion of the thus configured through hole 38 constitutes the nozzle 8 while the other portion of the through hole 38 constitutes a wide gap portion 36*a* (see FIG. 9) which is a portion of the adhesive region.

On the ejecting side surface of the nozzle plate 29, a water repellent film 30 made of, for example, Ni-PTFE (polytetrafluoroethylene) is formed by, for example, using electrolytic plating. By the water repellent film 30, it is prevented that an ink residue stays at the periphery of the nozzle 8. Consequently, the deterioration of the accuracy of the ejecting operation of the ink can be prevented.

Figure 8:
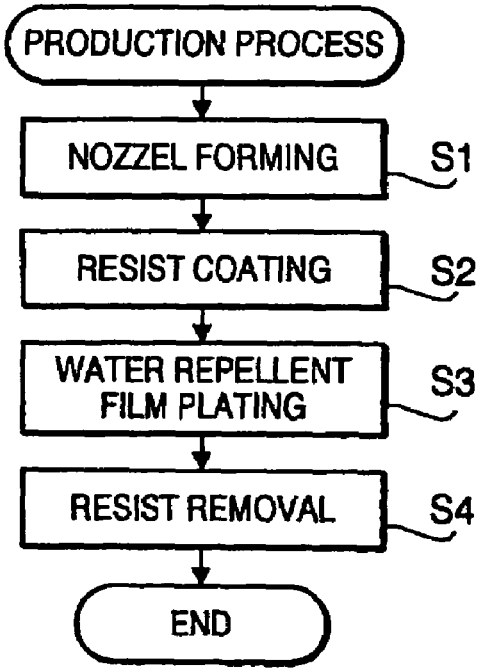
FIG. 8 is a flowchart illustrating a production process of a nozzle plate.

FIG. 8 is a flowchart illustrating a production process of the nozzle plate 29. The nozzle plate 29 is made of, for example, a conductive thin metal plate. In a nozzle forming process (step S1), the plurality of through holes 38 including the nozzles 8 are formed through the nozzle plate 29 by using, for example, press working.

As described above, the through hole 38 includes the cylindrical surface portion 38*b*, the conical surface portion 38*c*, and the curved surface portion 38*d*. During the press working of the nozzle plate 29, the cylindrical surface portion 38*b* and the conical surface portion 38*c* are formed in accordance with the shape of a punching member.

The curved surface portion 38*d* is formed by an effect of the deep drawing of the press working. That is, by the effect of the deep drawing, material of a peripheral portion of the conical surface portion 38*c* flows toward a direction opposite to the conical surface portion 38*c*, so that the curved surface portion 38*d* which is continuously connected to the conical surface portion 38*c* is formed.

In a resist coating process (step S2), the ejecting side surface of the nozzle plate 29 is coated with a resist, so that each nozzle 8 is filled with the resist. Consequently, it is prevented that the water repellent film adheres to an internal surface of each nozzle 8.

Next, in a water repellent film plating process (step S3), the water repellent film made of, for example, the Ni-PTFE film, is formed on the ejecting side surface of the nozzle plate 29 using, for example, an electrolytic plating. In a resist removal process (step S4), the resist filled in the nozzle 8 is removed. By the above mentioned production process, the nozzle plate 29 having the water repellent film 30 is obtained.

Figure 9:
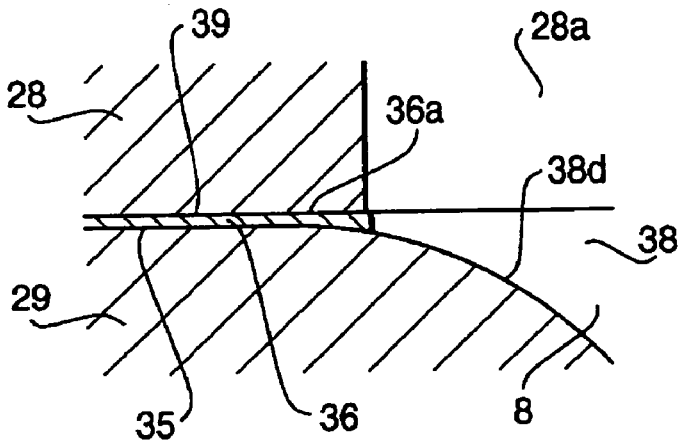
FIG. 9 is shows a detailed configuration of a wide gap portion according to the first embodiment.

FIG. 9 is an enlarged view of a section G of FIG. 7. That is, FIG. 9 is a cross sectional view of the head unit 70 illustrating a detailed configuration of the curved portion 38*d* of the through hole 38. During the manufacturing process of the head unit 70, the adhesive 35 is applied to the ejecting side surface of the cover plate 28, and then the nozzle plate 29 is pressed against the cover plate 28. Consequently, as shown in FIG. 9, an adhesive layer 36 is formed between the cover plate 28 and the nozzle plate 29.

In the following explanation, a gap formed, by the adhesive layer 36, between the nozzle plate 29 and the cover plate 28 except the openings 28*a* is represented by a gap 39. Also, terms "thickness of the gap" are used to represent the length of the gap 39 in a lamination direction of the cover plate 28 and the nozzle plate 29.

The gap 39 has wide gap portions 36*a*, each of which lies in the vicinity of the through hole 38. The wide gap portion 36*a* is formed by the curved surface portion 38*d* of the through hole 38 and the ejecting side surface of the cover plate 28. The thickness of the wide gap portion 36*a* increases as a position at which the thickness is measured approaches the through hole 38, so that the cross section of the wide gap portion 36*a* in FIG. 9 has a form of a wedge.

With this configuration, a portion of the adhesive, which is pressed toward the through hole 38 when the nozzle plate 29 and the cover plate 28 are laminated, can be trapped in the wide gap portion 36*a* by a capillary action. Consequently, it is prevented that the portion of the adhesive protrudes into the through hole 38.

Therefore, according to the first embodiment of the invention, it is prevented that the adhesive flows into the nozzle 8. The accuracy of the ejecting operation of the ink can be enhanced without increasing the size of the opening of the nozzle 8 (i.e., the through hole 38).

An additional process is not required to form the wide gap portion 36*a* because the curved surface portion 38*d*, which constitutes the wide gap portion 36*a*, can be formed by the press working simultaneously with formation of the cylindrical surface portion 38*b* and the conical surface portion 38*c*. Therefore, the wide gap portion 36*a* can be formed without increasing the man-hours for manufacturing the head portion 70.

Second Embodiment

Hereafter, an inkjet head according to a second embodiment of the invention will be described. The inkjet head of the second embodiment has the same configuration as the inkjet head 1 of the first embodiment with regard to the configuration described with reference to FIGS. 1 to 8. In the following explanations, the feature of the second embodiment (i.e., the configuration of the through hole 38 and the wide gap portion 36*a* of the inkjet head of the second embodiment) will be explained.

Figure 10:
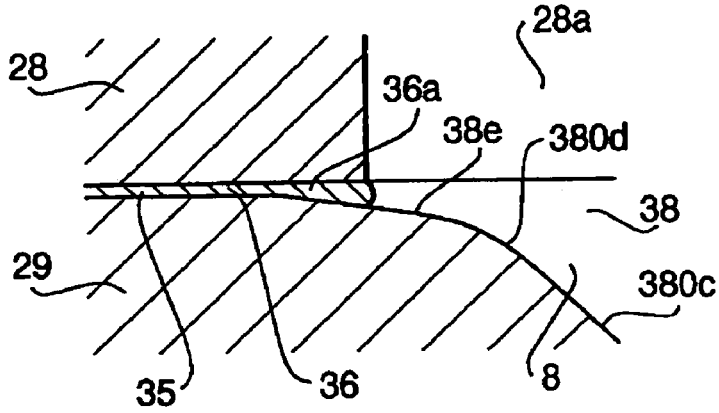
FIG. 10 shows a detailed configuration of a wide gap portion according to a second embodiment.

Similarly to FIG. 9, FIG. 10 is a cross sectional view of the head unit 70 illustrating a detailed configuration of the nozzle 8. In FIG. 10, to elements which are substantially the same as those of the first embodiment, the same reference numbers are assigned. As shown in FIG. 10, the adhesive layer 36 lies between a portion of the cover plate 28 except the openings 28*a* and the nozzle plate 29.

In this embodiment, the through hole 38 has the cylindrical surface portion 38*b*, a conical surface portion 380*c* having a shape corresponding to the conical surface portion 38*c* of the first embodiment, a curved surface portion 380*d* having a shape corresponding to the curved surface portion 38*d* of the first embodiment.

Further, the through hole 38 has a conical surface portion 38*e* which is continuously connected to the curved surface portion 380*d* and which has an angle of inclination, with respect to a horizontal line, smaller than that of the conical surface portion 380*c* (i.e., the conical surface portion 38*c*). The maximum diameter of the conical surface portion 38*e* is larger than the diameter of the opening 28*a*.

In this embodiment, the wide gap portion 36*a* is formed by the ejecting side surface of the cover plate 28 and the conical surface portion 38*e* of the through hole 38. The thickness of the wide gap portion 36*a* increases as a position at which the thickness is measured approaches the through hole 38, so that the cross section of the wide gap portion 36*a* in FIG. 10 has a form of a wedge.

Similarly to the first embodiment, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38).

By performing the press working using the punching member having a shape corresponding to the cylindrical surface portion 38*b* and the conical surface portion 380*c*, the curved surface portion 380*d* and the conical surface portion 38*e* can be formed by the effect of the deep drawing of the press working. Therefore, the wide gap portion 36*a* can be formed without increasing the man-hours for manufacturing the head portion 70.

Third Embodiment

Hereafter, an inkjet head according to a third embodiment of the invention will be described. The inkjet head of the third embodiment has the same configuration as the inkjet head 1 of the first embodiment with regard to the configuration described with reference to FIGS. 1 to 8. In the following explanations, the feature of the third embodiment (i.e., the configuration of the through hole 38 and the wide gap portion 36*a* of the inkjet head of the third embodiment) will be explained.

Figure 11:
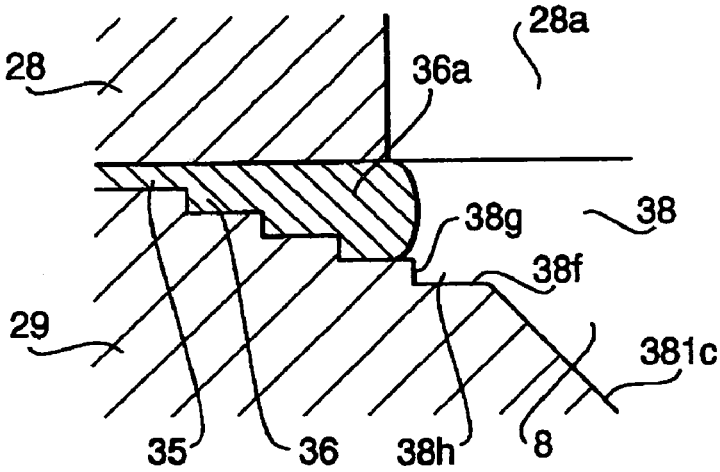
FIG. 11 shows a detailed configuration of a wide gap portion according to a third embodiment.

Similarly to FIG. 9, FIG. 11 is a cross sectional view of the head unit 70 illustrating a detailed configuration of the nozzle 8. In FIG. 11, to elements which are substantially the same as those of the first embodiment, the same reference numbers are assigned. As shown in FIG. 11, the adhesive layer 36 lies between the nozzle plate 29 and a portion of the cover plate 28 except the openings 28*a*.

In this embodiment, the through hole 38 has the cylindrical surface portion 38*b* (not shown in FIG. 11), a conical surface portion 381*c* having a shape corresponding to the conical surface portion 38*c* of the first embodiment, and a step-like portion including a plurality of pairs of an annular surface portion 38*f* and a cylindrical surface portion 38*g*. The maximum diameter of the step-like portion is larger than the diameter of the opening 28*a*.

The wide gap portion 36*a* is formed between a portion of the ejecting side surface of the cover plate 28 located in the vicinity of the opening 28*a* and the step-like portion of the nozzle plate 29. The thickness of the wide gap portion 36*a* increases as a position at which the thickness is measured approaches the through hole 38, so that the cross section of the wide gap portion 36*a* in FIG. 11 has a form of a wedge.

Similarly to the first embodiment, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38).

Similarly to the first and second embodiments, the wide gap portion 36*a* can be formed by using the press working without increasing the man-hours for manufacturing the head portion 70.

As shown in FIGS. 9, 10 and 11, in the cross section parallel with a lamination direction of the cover plate 28 and the nozzle plate 29, the wedge shape of the wide gap portion 36*a* may be defined by various types of boundary lines including a straight line, a curved line, and a step-like line.

Fourth Embodiment

Hereafter, an inkjet head according to a fourth embodiment of the invention will be described. The inkjet head of the fourth embodiment has the same configuration as the inkjet head 1 of the first embodiment with regard to the configuration described with reference to FIGS. 1 to 8. In the following explanations, the feature of the fourth embodiment (i.e., the configuration of the through hole 38 and the wide gap portion 36*a* of, the inkjet head of the fourth embodiment) will be explained.

Figure 12:
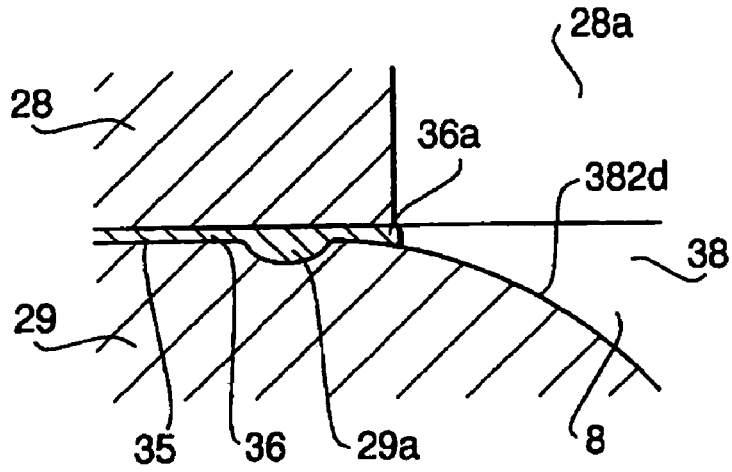
FIG. 12 shows a detailed configuration of a wide gap portion according to a fourth embodiment.

Similarly to FIG. 9, FIG. 12 is a cross sectional view of the head unit 70 illustrating a detailed configuration of the nozzle 8. In FIG. 12, to elements which are substantially the same as those of the first embodiment, the same reference numbers are assigned. As shown in FIG. 12, the adhesive layer 36 lies between the nozzle plate 29 and a portion of the cover plate 28 except the openings 28*a*.

In this embodiment, the through hole 38 has the cylindrical surface portion 38*b* (not shown in FIG. 12), the conical surface portion 38*c*, and a curved surface portion 382*d* having a shape corresponding to the curved surface portion 38*d* of the first embodiment. The curved surface portion 382*d* has a groove 29*a* which is shown in FIG. 12 as a concave surface. The maximum diameter of the curved surface portion 382*d* is larger than the diameter of the opening 28*a*.

With this configuration, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38). Since the curved surface portion 382*d* has the groove 29*a*, the above mentioned advantageous can be enhanced.

Figure 13:
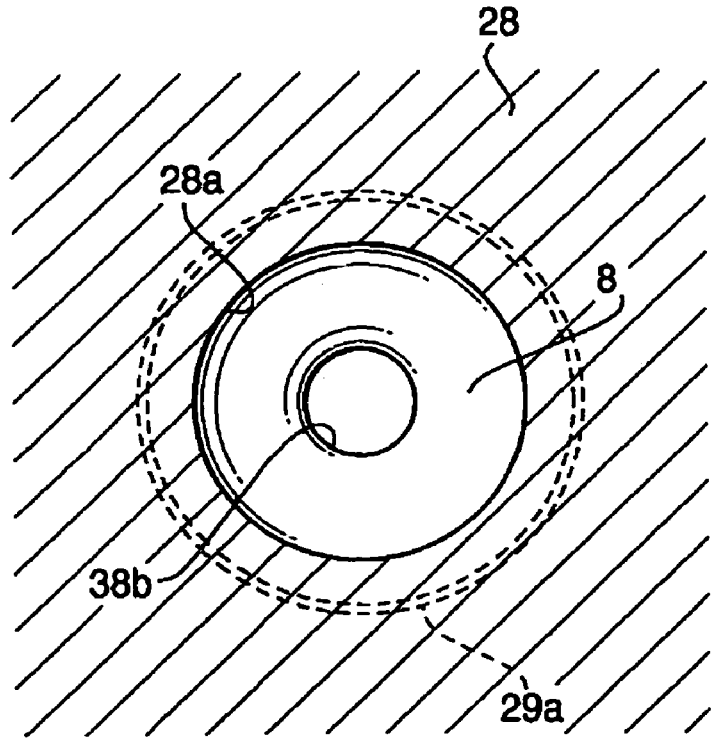
FIG. 13 is a top view of the wide gap portion shown in FIG. 12.

FIG. 13 shows a top view of the nozzle 8 shown in FIG. 12 viewed from an upper side of FIG. 12. As shown in FIG. 13, the groove 29*a* has a circular shape when it is viewed as the top view. The opening 28*a* of the cover plate 28 and the cylindrical surface portion 38*b* of the nozzle plate 29 are also shown in FIG. 13.

Figure 14:
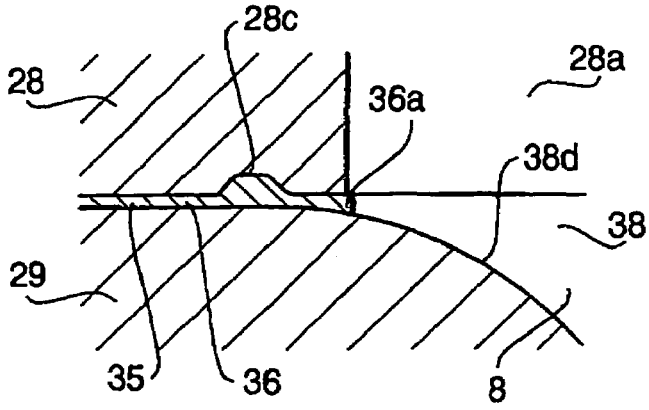
FIG. 14 shows a variation of the wide gap portion shown in FIG. 12.

Although in this embodiment the groove is formed on the curved surface portion 382*d* of the nozzle plate 29, a groove similar to the groove 29*a* may be formed on the ink ejecting side-surface of the cover plate 28 in place of the groove 29*a* of the nozzle plate 29 or in addition to the groove 29*a* of the nozzle plate 29. FIG. 14 shows a configuration of the nozzle 8 of this type. In the configuration shown in FIG. 14, a groove 28*c* is formed on the ink ejecting side surface of the cover plate 28. In FIG. 14, to elements which are substantially the same as those shown in FIG. 12, the same reference numbers are assigned.

Fifth Embodiment

Hereafter, an inkjet head according to a fifth embodiment of the invention will be described. The inkjet head of the fifth embodiment has the same configuration as the inkjet head 1 of the first embodiment with regard to the configuration described with reference to FIGS. 1 to 8. In the following explanations, the feature of the fifth embodiment (i.e., the configuration of the through hole 38 and the wide gap portion 36*a* of the inkjet head of the fifth embodiment) will be explained.

Figure 15:
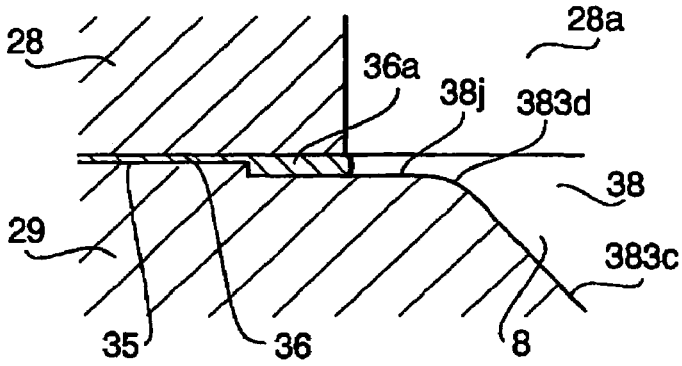
FIG. 15 shows a detailed configuration of a wide gap portion according to a fifth embodiment.

Similarly to FIG. 9, FIG. 15 is a cross sectional view of the head unit 70 illustrating a detailed configuration of the nozzle 8. In FIG. 15, to elements which are substantially the same as those of the first embodiment, the same reference numbers are assigned. As shown in FIG. 15, the adhesive layer 36 lies between the nozzle plate 29 and a portion of the cover plate 28 except openings 28*a*.

In this embodiment, the through hole 38 has the cylindrical surface portion 38*b* (not shown in FIG. 15), a conical surface portion 383*c* having a shape corresponding to the conical surface portion 38*c* of the first embodiment, and a curved surface portion 383*d* having a shape corresponding to the curved surface portion 38*d* of the first embodiment.

As shown in FIG. 15 on the curved surface portion 383*d*, a countersunk portion 38*j* is formed. The wide gap portion 36*a* is formed by the cover plate 28 and the countersunk portion 38*j*.

With this configuration, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38).

Sixth Embodiment

Hereafter, an inkjet head according to a sixth embodiment of the invention will be described. The inkjet head of the sixth embodiment has the same configuration as the inkjet head 1 of the first embodiment with regard to the configuration described with reference to FIGS. 1 to 8. In the following explanations, the feature of the sixth embodiment (i.e., the configuration of the through hole 38 and the wide gap portion 36*a* of the inkjet head of the sixth embodiment) will be explained.

Figure 16:
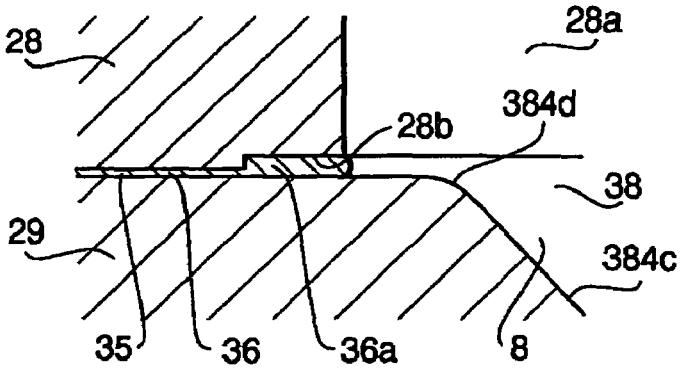
FIG. 16 shows a detailed configuration of a wide gap portion according to a sixth embodiment.

Similarly to FIG. 9, FIG. 16 is a cross sectional view of the head unit 70 illustrating a detailed configuration of the nozzle 8. In FIG. 16, to elements which are substantially the same as those of the first embodiment, the same reference numbers are assigned. As shown in FIG. 16, the adhesive layer 36 lies between the nozzle plate 29 and a portion of the cover plate 28 except the openings 28*a*.

In this embodiment, the through hole 38 has the cylindrical surface portion 38*b* (not shown in FIG. 16), a conical surface portion 384*c* having a shape corresponding to the conical surface portion 38*c* of the first embodiment, and a curved surface portion 384*d* having a shape corresponding to the curved surface portion 38*d* of the first embodiment.

In this embodiment, a countersunk portion 28*b* is formed on the ejecting side surface of the cover plate 28 in the vicinity of the opening 28*a*. The wide gap portion 36*a* is formed by the nozzle plate 29 and the countersunk portion 28*b* of the cover plate 28.

With this configuration, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38).

Although in this embodiment the countersunk portion 28*d* is formed as a plane surface, a dish-shaped countersunk portion or a countersunk portion formed by a curved line in the cross section of FIG. 16 may be used to form the countersunk portion 28*b* on the cover plate 28.

Seventh Embodiment

Hereafter, an inkjet head according to a seventh embodiment of the invention will be described. The inkjet head of the seventh embodiment has the same configuration as the inkjet head 1 of the first embodiment with regard to the configuration described with reference to FIGS. 1 to 8. In the following explanations, the feature of the seventh embodiment (i.e., the configuration of the through hole 38 and the wide gap portion 36*a* of the inkjet head of the seventh embodiment) will be explained.

Figure 17:
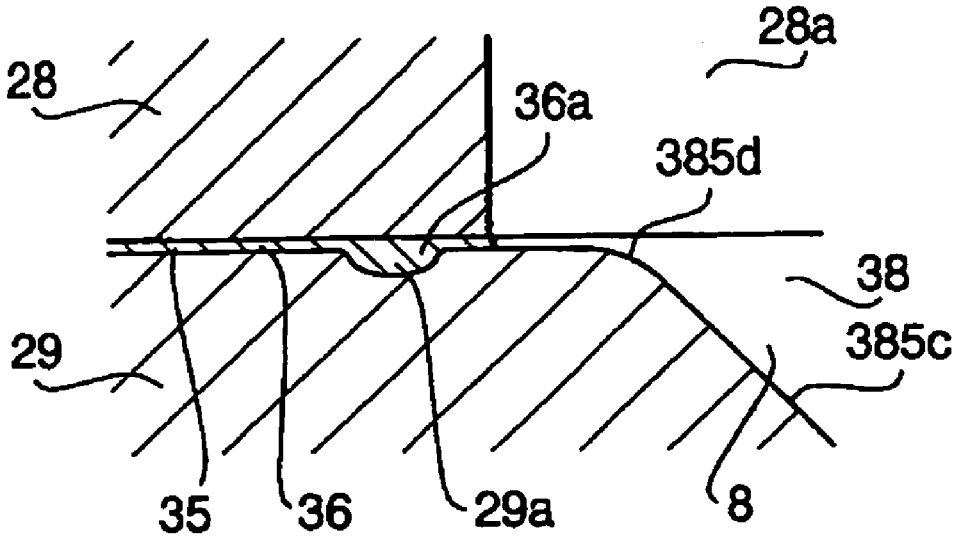
FIG. 17 shows a detailed configuration of a wide gap portion according to a seventh embodiment.

Similarly to FIG. 9, FIG. 17 is a cross sectional view of the head unit 70 illustrating a detailed configuration of the nozzle 8. In FIG. 17, to elements which are substantially the same as those of the first embodiment, the same reference numbers are assigned. As shown in FIG. 17, the adhesive layer 36 lies between the nozzle plate 29 and a portion of the cover plate 28 except the openings 28*a*.

In this embodiment, the through hole 38 has the cylindrical surface portion 38*b* (not shown in FIG. 17), a conical surface portion 385*c* having a shape corresponding to the conical surface portion 38*c* of the first embodiment, and a curved surface portion 385*d* having a shape corresponding to the curved surface portion 38*d* of the first embodiment.

On the nozzle plate 29, a groove 29*a* is formed at the periphery of the through hole 38 (i.e., the nozzle 8). The wide gap portion 36*a* is formed by the groove 29*a* of the nozzle plate 29 and the ejecting side surface of the cover plate 28. The grove 29*a* traps a portion of the adhesive 35 during the manufacturing process of the head unit 70.

With this configuration, it is prevented that the adhesive 35 flows into the nozzle 8 during the manufacturing process of the head unit 70. The accuracy of the ejecting operation of the ink can be enhanced without increasing the size of the opening of the nozzle 8 (i.e., the through hole 38).

Although in this embodiment the groove 29*a* is formed on the nozzle plate 29, a groove may be formed on the ejecting side surface of the cover plate 28 in place of the groove 29*a* of the nozzle plate 29 or in addition to the groove 29*a* of the nozzle plate 29.

Eighth Embodiment

Hereafter, an inkjet head according to a eighth embodiment of the invention will be described. The inkjet head of the eighth embodiment has the same configuration as the inkjet head 1 of the first embodiment with regard to the configuration described with reference to FIGS. 1 to 8. In the following explanations, the feature of the eighth embodiment (i.e., the configuration of the through hole 38 and the wide gap portion 36*a* of the inkjet head of the eighth embodiment) will be explained.

Figure 18:
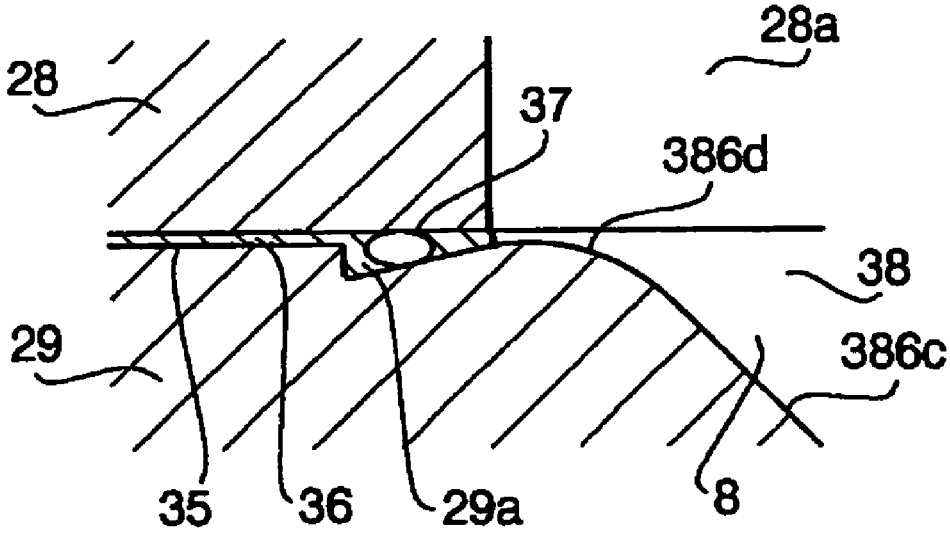
FIG. 18 shows a detailed configuration of a wide gap portion according to an eighth embodiment.

Similarly to FIG. 9, FIG. 18 is a cross sectional view of the head unit 70 illustrating a detailed configuration of the nozzle 8. In FIG. 18, to elements which are substantially the same as those of the first embodiment, the same reference numbers are assigned. As shown in FIG. 18, the adhesive layer 36 lies between the nozzle plate 29 and a portion of the cover plate 28 except the openings 28*a*.

In this embodiment, the through hole 38 has the cylindrical surface portion 38*b* (not shown in FIG. 17), a conical surface portion 386*c* having a shape corresponding to the conical surface portion 38*c* of the first embodiment, and a curved surface portion 386*d* having a shape corresponding to the curved surface portion 38*d* of the first embodiment.

The wide gap portion 36*a* is formed by the cover plate 28 and the curved surface portion 386*d* of the through hole 38. On the curved surface portion 386*d* of the nozzle plate 29, a groove 29*a* is formed. As shown in FIG. 18, the wide gap portion 36*a* defined by the groove 29*a* tapers down toward the through hole 38. That is, the wade gap portion 36*a* is formed such that the gap firstly increases at a position away from the through hole 38 and then decreases gradually toward the through hole 38.

With this configuration, it is prevented that the adhesive 35 flows into the nozzle 8 during the manufacturing process of the head unit 70 because the adhesive can be trapped in the wide gap portion 36*a*. The accuracy of the ejecting operation of the ink can be enhanced without increasing the size of the opening of the nozzle 8 (i.e., the through hole 38).

Since the groove 29*a* is formed on the curved surface portion 386*d* of the nozzle plate 29, the effect of preventing the flowing of the adhesive 35 into the through hole 38 during the manufacturing process of the head unit 70 can be further enhanced.

If the amount of the adhesive 35 is relatively low, a bubble 37 may be formed in the groove 29*a*. However, as described above, the wide gap portion 36*a* defined by the groove 29*a* tapers down toward the through hole 38 (i.e., the gap between the cover plate 28 and the groove 29 is very narrow at a position nearest to the through hole 38). Accordingly, the bubble 37 is trapped by the surface tension of the adhesive 37 in the groove 29*a*. That is, no air gap connecting the bubble 37 and the through hole 38 is made.

Therefore, it is prevented that a portion of the ink, which enters the air gap formed in the adhesive layer 36, stays for a relatively long time in the wide gap portion 36*a*, alters its quality, and thereby deteriorates the accuracy of the ejecting operation of the ink.

Although in this embodiment the groove 29*a* is formed on the curved surface portion 386*d* of the nozzle plate 29, a groove may be formed on the ejecting side surface of the cover plate 28 in place of the groove 29*b* of the nozzle plate 29 or in addition to the groove 29*a* of the nozzle plate 29.

Although the present invention has been described in considerable detail with reference to certain preferred embodiments thereof, other embodiments are possible.

In the above mentioned embodiments, the wide gap portion 36*a* is formed between a plane surface (of one of the cover plate 28 and the nozzle plate 29) and a groove, a countersunk portion or a curved surface portion (formed on the other of the cover plate 28 and the nozzle plate 29). However, the groove, the countersunk portion or the curved surface portion for making the wide gap portion 36*a* may be formed on both of the cover plate 28 and the nozzle plate 29.

In the above mentioned embodiments, the curved surface portion 38*d* is formed by using the effect of the deep drawing in the press working, the curved surface portion 38*d* may be formed in different ways.

The present disclosure relates to the subject matter contained in Japanese Patent Application No. 2003-188997, filed on Jun. 30, 2003, which is expressly incorporated herein by reference in its entirety.

What is claimed is:

1. An inkjet head, comprising:

a nozzle plate that has a plurality of nozzles from which ink is ejected; and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate, wherein a gap is formed between opposed surfaces of the cover plate and the nozzle plate, the gap being filled with the adhesive, wherein the gap has a wide gap portion whose thickness is larger than that of the other portion of the gap, wherein a surface of the nozzle plate forming the wide gap portion is configured to be a curved portion, and wherein at least one of the opposed surfaces of the cover plate and the nozzle plate forming the wide gap portion has a groove.

2. The inkjet head according to claim 1, wherein the wide gap portion is formed in the vicinity of each of the plurality of nozzles.

3. The inkjet head according to claim 2, wherein a thickness of the wide gap portion becomes larger at a point closer to corresponding one of the plurality of nozzles.

4. The inkjet head according to claim 2, wherein the wide gap portion has a form of a wedge in a cross section parallel with a lamination direction of the cover plate and the nozzle plate.

5. The inkjet head according to claim 2, wherein at least one of the opposed surfaces of the cover plate and the nozzle plate forming the wide gap portion has a countersunk portion.

6. The inkjet head according to claim 2, wherein a surface of the cover plate forming the wide gap portion is a planar surface, wherein the surface of the nozzle plate forming the wide gap portion is configured such that a thickness of the wide gap portion becomes larger at a point closer to corresponding one of the plurality of nozzles.

7. The inkjet head according to claim 2, wherein a thickness of the wide gap portion firstly increases and then decreases gradually at a point closer to corresponding one of the plurality of nozzles.

8. The inkjet head according to claim 1, wherein the surface of the nozzle plate forming the wide gap portion is continuously connected to an inside surface of the corresponding one of the plurality of nozzle.

9. The inkjet head according to claim 8, wherein a plurality of through holes corresponding to the plurality of nozzles are formed through the nozzle plate by press working, each of the plurality of through holes having the curved portion and the inside surface.

10. The inkjet head according to claim 9, wherein the curved portion is formed by an effect of deep drawing of the press working.

11. The inkjet head according to claim 1, wherein each opening of the plurality of openings is aligned with a respective nozzle of the plurality of nozzles.

12. The inkjet head according to claim 1, wherein the plurality of openings are formed within the cover plate.

13. An inkjet head, comprising:

a nozzle plate that has a plurality of nozzles from which ink is ejected; and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate, wherein the nozzle plate has a plurality of through holes respectively corresponding to the plurality of nozzles, each of the plurality of through holes including:

a first hole portion that has a cylindrical inside surface, one end of the first hole portion being situated on an ejecting side surface of the nozzle plate;

a second hole portion that has an conical inside surface continuously connected to the other end of the first hole portion, a diameter of the second hole portion monotonously increases toward the cover plate side; and a third hole portion having an inside surface which is continuously connected to the second hole portion, a diameter of the third hole portion increases toward the cover plate side, one end of the third hole portion facing an ejecting side surface of the cover plate, the diameter of the third hole portion on a surface of the nozzle plate opposed to the ejecting side surface of the nozzle plate being larger than a diameter of corresponding one of the plurality of openings of the cover plate, wherein a gap is formed between opposed surfaces of the cover plate and the nozzle plate, the gap being filled with the adhesive, wherein the gap has a wide gap portion whose thickness is larger than that of the other portion of the gap, wherein the wide gap portion is formed for each of the plurality of nozzles, the wide gap portion being formed by the ejecting side surface of the cover plate and a surface of the third hole portion of each of the plurality of through holes of the nozzle plate.

14. An inkjet head, comprising:

a nozzle plate that has a plurality of nozzles from which ink is ejected; and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate, wherein a gap is formed between opposed surfaces of the cover plate and the nozzle plate, the gap being filled with the adhesive, wherein the gap has a wide gap portion whose thickness is larger than that of the other portion of the gap, and wherein at least one of the opposed surfaces of the cover plate and the nozzle plate forming the wide gap portion has a countersunk portion.

15. The inkjet head according to claim 14, wherein the wide gap portion is formed in the vicinity of each of the plurality of nozzles.

16. The inkjet head according to claim 14, wherein the wide gap portion is formed in the vicinity of each of the plurality of nozzles.

17. An inkjet head, comprising:

a nozzle plate that has a plurality of nozzles from which ink is ejected; and a cover plate that has a plurality of openings respectively corresponding to the plurality of nozzles, the cover plate and the nozzle plate being adhered to each other with an adhesive so that the plurality of nozzles of the nozzle plate respectively communicate with the plurality of openings of the cover plate, wherein a gap is formed between opposed surfaces of the cover plate and the nozzle plate, the gap being filled with the adhesive, wherein the gap has a wide gap portion whose thickness is larger than that of the other portion of the gap, and wherein at least one of the opposed surface of the cover plate and the nozzle plate forming the wide gap portion has a step-like portion including a plurality of pairs of an annular surface portion and a cylindrical surface portion.

* * * * *